US005133467A

United States Patent [19]

Hawthorne et al.

[11] Patent Number: 5,133,467

[45] Date of Patent: Jul. 28, 1992

[54] WEDGE SHIM AND FOLLOWER BLOCK FOR A RAILCAR ARTICULATED CONNECTOR

[75] Inventors: V. Terrey Hawthorne, Lyle; Horst T. Kaufhold, Chicago, both of Ill.; John F. Oesch, Alliance, Ohio

[73] Assignee: AMSTED Industries Incorporated, Chicago, Ill.

[21] Appl. No.: 692,704

[22] Filed: Apr. 29, 1991

[51] Int. Cl.[5] ..... B61G 9/00

[52] U.S. Cl. ..... 213/59; 213/56

[58] Field of Search ..... 105/3, 4.1, 4.2, 4.3; 213/75 R, 74, 77, 62 R, 62 A, 12, 50, 56, 58, 59, 60, 61; 384/450, 626

[56] References Cited

U.S. PATENT DOCUMENTS

| | | | |
|---|---|---|---|
| 3,716,146 | 2/1973 | Altherr | 213/75 R |
| 4,258,628 | 3/1981 | Altherr | 213/75 R |
| 4,336,758 | 6/1982 | Radwill | 105/4 R |
| 4,593,827 | 6/1986 | Altherr | 213/56 |
| 4,593,829 | 6/1986 | Altherr | 213/4 R |
| 4,637,518 | 1/1987 | Hanula | 213/64 |
| 4,946,052 | 8/1990 | Kaim et al. | 213/61 |

FOREIGN PATENT DOCUMENTS

| | | | |
|---|---|---|---|
| 2169569 | 7/1986 | United Kingdom | 213/62 R |

*Primary Examiner*—Robert J. Oberleitner
*Assistant Examiner*—Mark T. Le
*Attorney, Agent, or Firm*—Edward J. Brosius; F. S. Gregorczyk

[57] ABSTRACT

An articulated railcar connector assembly includes improved wedge shim and follower block components that are shaped for improved early service life, the wedge shim having laterally spaced vertical lands to contact the assembly end wall and the follower block having a compound curvature bearing surface to receive the end of a male connector member; and both wedge and follower block may have abutting chevron-like concave and convex bearing surfaces wherein the included angle of the convex bearing surfaces exceeds the included angle of the concave bearing surfaces.

15 Claims, 4 Drawing Sheets

WEDGE SHIM AND FOLLOWER BLOCK FOR A RAILCAR ARTICULATED CONNECTOR

This invention relates to the art of railcar connectors, especially articulated connectors; and more specifically is directed to improved follower block and wedge components that function to receive buff loading within the connector and to fill up space created between parts due to wear.

BACKGROUND OF THE INVENTION

Connectors for railcars are usually pivotally attached to each end of a car center sill. A convex end of a male connector part normally rests against a follower block held within a female sill pocket casting that is mounted within the car sill to withstand longitudinal forces tending to thrust the connector into the sill (compressive or buff loading). The connector is held from being pulled from the sill (draft loading) by a pin or drawbar or by a collar that is spaced from the follower block. For consistent orientation in the following text, the terms "forward" will refer to the longitudinal direction into the female pocket, the term "rear" (or rearward) will refer to the opposite direction, and the term "lateral" will refer to a direction transverse to longitudinal .

Several types of connectors are available to extend between successive railcars such as couplers, drawbars and articulated connectors. In coupler and drawbar connections, there are female sill pockets at each railcar platform end and a male connector member is received in each. Thus, relative movement between successive platforms is divided between the two connector ends. That is, if the successive platforms are angled 10 degrees each of the two male connectors will move only 5 degrees. However, in articulated connectors, there is a single pivotal connection between a single set of male and female members that are rigidly attached respectively to the adjacent ends of successive car platforms. Thus, when articulated platforms angle 10 degrees, the single male connector must move 10 degrees in the female pocket.

In newly assembled connectors, the clearances between the aforementioned parts are minimal, and there is virtually no slack or movement of the parts longitudinal of the car when forces on the connectors are reversed, as occurs each time the car is accelerated or decelerated. However, usage induces wear on various parts, and gradually, spaces will be created. Such spaces are known as slack. Slack is undesirable as it causes repetition and magnification of impact forces when a train of cars is accelerated and decelerated. Yet a degree of slack in each pivotable connection is needed for the purposes of assembling and disassembling the parts, which must be done from time to time.

Ordinarily in freight car construction, slack is compensated and taken up by locating a wedge-shaped shim between two of the connector parts, usually between the follower block and a closed end of a sill pocket as shown in prior U.S. Pat. Nos. 3,716,146, 4,456,133 and 4,549,666. As will be seen in the prior art, the wedge usually inserts downwardly by gravity although it can be spring loaded in other directions. In articulated connectors a wedge is placed between the follower block and an end wall of the female member as shown in prior U.S. Pat. Nos. 4,258,628, 4,336,758 and 4,593,829. In operation, the wedge becomes further inserted to maintain compression between the parts as wear enlarges the spaces.

It has now been found that when the aforementioned connector parts are first assembled and operated, the wedge will assume a position that will cause binding and excessive wear between the parts during early service life. Unfortunately, this leads to accelerated and uneven wear and overall will shorten the service life of the parts, particularly the wedge. The problem is in part caused by the connector, follower and wedge components being unmachined cast steel (preferably manganese steel). That is the components, have mating surfaces that are cast to include congruent curved and angled surfaces, and the "as cast" tolerances do not result in ideal mating surfaces due to varying radii, angles, and imperfect features of cast surfaces. The components have not been machined for reasons of economy. Heretofore, it has been assumed that the mating surfaces would wear into appropriate proper fit during a break-in portion of early service life. However, it is now known that a, heretofore unrecognized, degree of premature wear has occurred. Furthermore, the premature wear has been an even larger problem in articulated connectors where relatively greater angling occurs in the connector member.

SUMMARY OF THE INVENTION

Accordingly, it is a principal object of the present invention to provide an improved wedge shim and follower block components having cast bearing surfaces that are preshaped to improve fit upon initial assembly.

It is another object of the present invention to provide an improved wedge shim having flat lands running the height of the lateral edges of the forward surface thereof to cause initial contact with a pocket end wall to occur at the laterally outward portions thereof.

It is a further object of the present invention to provide an improved follower block having a concavity on the rear face thereof to receive the butt end of a male connector wherein the concavity includes an outer partial spherical annulus of one radius and an inner partial spherical cavity of a smaller radius to cause initial contact with the connector butt end to occur at the center of said concavity.

It is still another object of the present invention to provide an improved articulated railcar connector having a wedge shim with flat lands on the forward face thereof and a follower block with a multiple radii concavity in the rear face thereof to improve initial fit of the articulated connector components and lessen the likelihood of the components binding during break-in operation.

Briefly stated, the invention involves wedge shim and follower block railcar connector components that have preshaped bearing surfaces devised to improve initial fit-up, particularly in an articulated connector assembly, and reduce the tendency for binding between the follower block and male connector components and to reduce the tendency for the wedge shim to bind and to rotate. This is accomplished by forming the central portions of the follower block concavity with a relatively shallower curvature than the outer position; and by providing raised outer lands running vertically along the forward surface of the wedge. A further improvement is available to a follower block and wedge shim having a chevron-like interface by forming the respective faces at dissimilar angles chosen to force initial contact at the lateral outer portions of the interface.

BRIEF DESCRIPTION OF THE DRAWINGS

Other objects and advantages of the invention will become apparent upon reading the following detailed description in conjunction with the drawings wherein.

DESCRIPTION OF A PREFERRED EMBODIMENT

Figure 1:
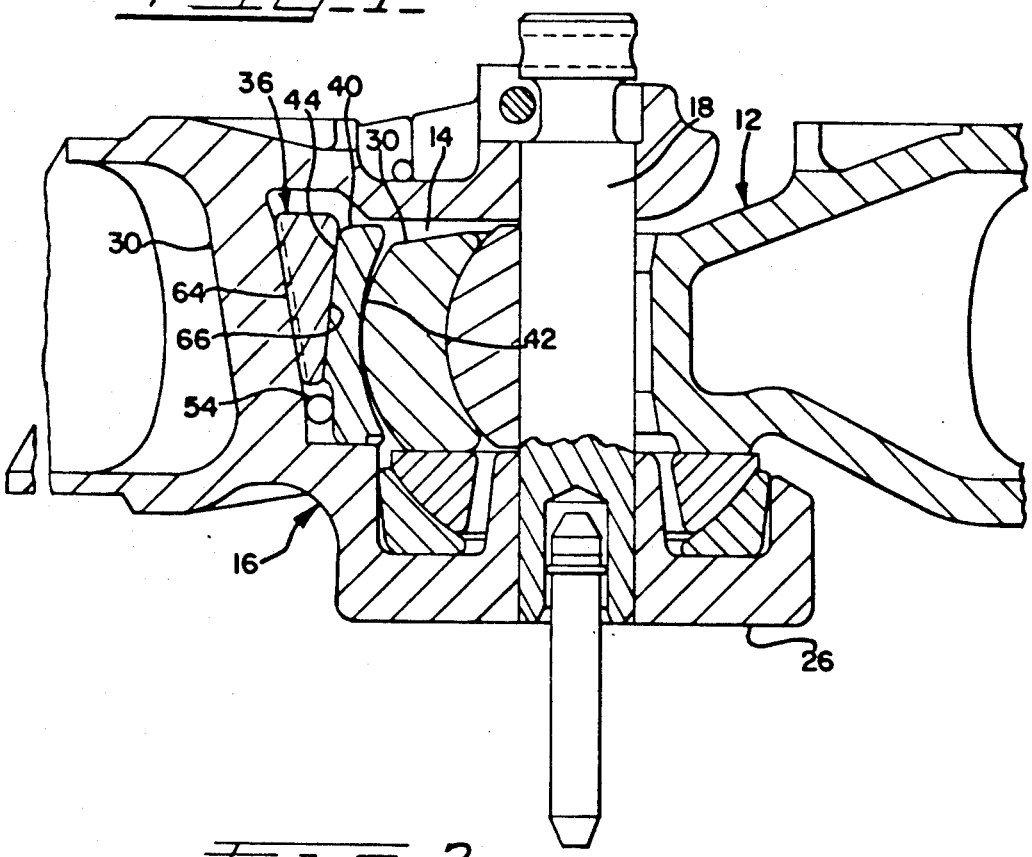
FIG. 1 is a sectional side elevation view of an articulated connector for railcars incorporating the present invention and showing the location of wedge-shim, follower block and other parts.
Figure 2:
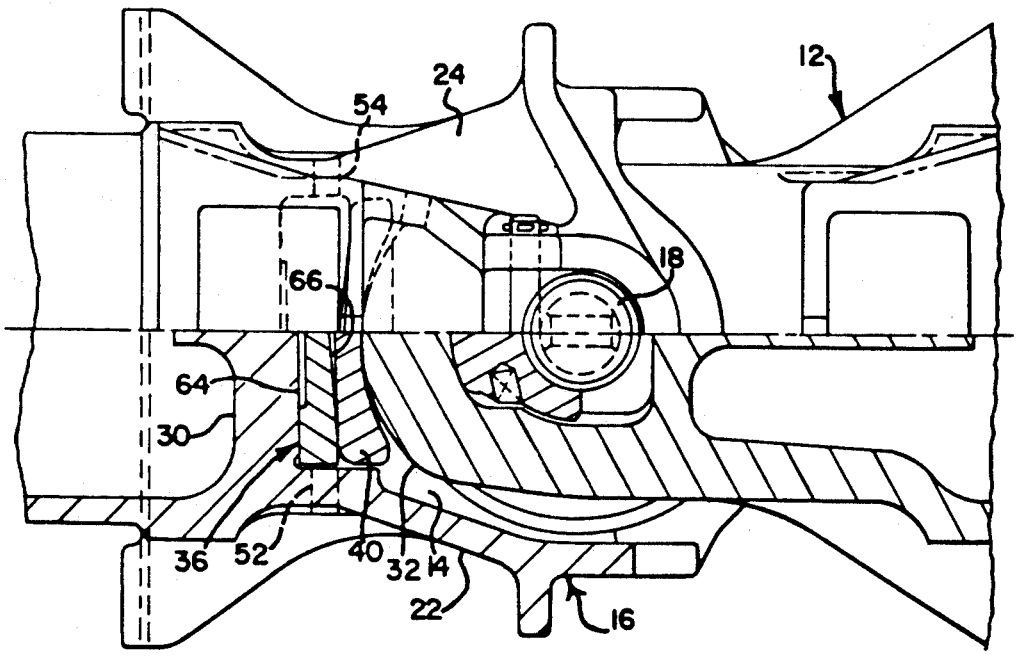
FIG. 2 is a plan view in partial section of the articulated connector of FIG. 1.
Figure 2A:
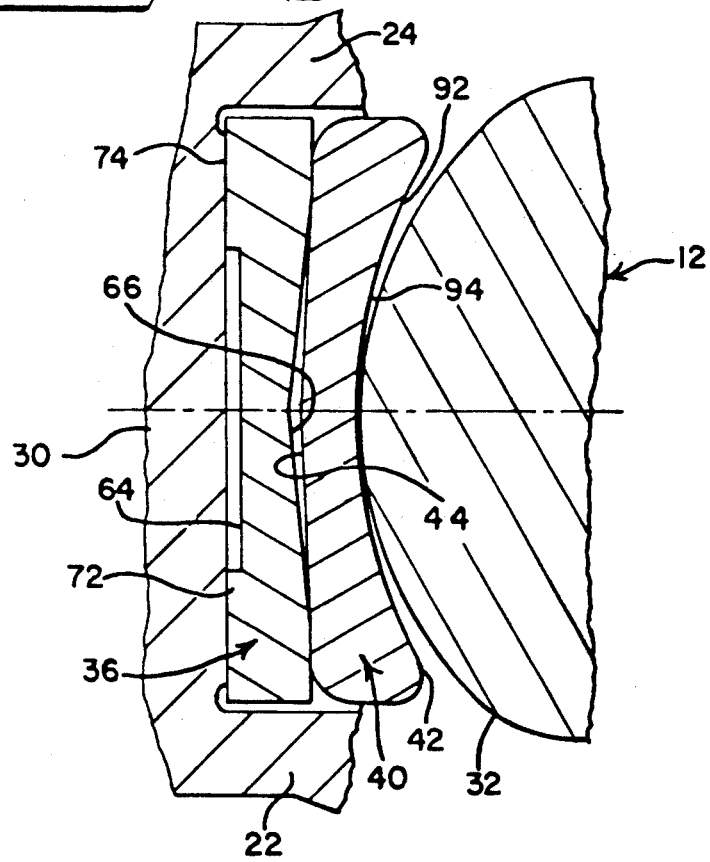
FIG. 2A is an exaggerated diagrammatic representation of a portion of FIG. 2.

While the wedge shim and follower block illustrated in the drawings may be combined with other types of railcar connections, the preferred embodiment was specifically devised for utilization in the articulated connector illustrated in FIGS. 1 and 2 wherein a male connector member, generally 12, is received within a hollow pocket 14 and held by a vertical pin 18 in a female member, generally 16.

The female member has a bottom enclosing structure that includes side walls 22, 24, and a downwardly extending exterior boss 26 designed to rest upon a center plate of a car truck (not shown); and the pin 18 extends vertically through both the male and female members 12, 16 centrally of the boss 26. Female pocket 14 terminates in an inclined end wall 30 extending laterally between the side walls 22, 24 and spaced from both the pin 18 and an arcuate forward end 32 of the male member 12. Arrayed between the end wall 30 and forward end 32 are a wedge, generally 36 and a bearing or follower block, generally 40. It will be seen that follower block 40 has a concave rear bearing surface 42 abutting the arcuate forward end 32 of male connector member 12 and an opposite forward face 44 which, in the illustrated embodiment, consists of two chevron-like angled surfaces. Wedge 36 is positioned within the pocket 14 between the inclined end wall 30 and the forward face 44 of follower block 40.

It will be understood that in some connector constructions either one or both of the end wall 30 and follower block forward face 44 may be inclined and the wedge suitably shaped. Also, the abutting pairs of surfaces of the end wall 30, wedge 36 and follower block 40 may be planar (e.g. flat) from side to side, or they may comprise angled surfaces (as shown in the FIGURES for the surfaces between the follower block 40 and wedge 36). At least one pair of angled surfaces is believed advantageous to hinder rotation of the wedge 36 and/or follower block 40. Heretofore, such angled surfaces on both abutting components have been formed to be congruent with the same included angle B on each.

Inspection or viewing portals 52, 54 are located in the respective side walls 22, 24 adjacent the bottom of end wall 30. Portals 52, 54 allow inspection of the wedge position and also provide access for tools to lift the wedge for disassembly when maintenance is required.

The preferred wedge 36, illustrated in FIGS. 3-6, includes a tapered body having a relatively broad top 62 and forward and rear bearing surfaces 64, 66, respectively that taper to a relatively narrow bottom 68. For purposes of orientation, the wedge forward bearing surface 64 is intended to abut the pocket end wall 30 which is a single plane for the assembled structure illustrated FIGS. 1 and 2. The wedge rear bearing surface 66 is intended to abut the angled forward face 44 of the follower block 40 and thus, comprises two flat surfaces 66A and 66B which join at the vertical center line of the rear surface to form an included angle $B^1$.

According to the present invention, the wedge forward bearing surface 64 is vertically bordered at the lateral sides by slightly raised lands 72, 74. This results in the main bearing surface 64 being slightly depressed between the lands 72, 74 which will, upon initial assembly, first contact the inclined end wall 30 of pocket 14. During a break-in period of the early service life of a connector assembly, the lands 72 and 74 will wear away and become essentialy co-planar with the central portion of the bearing surface 64.

Figure 3:
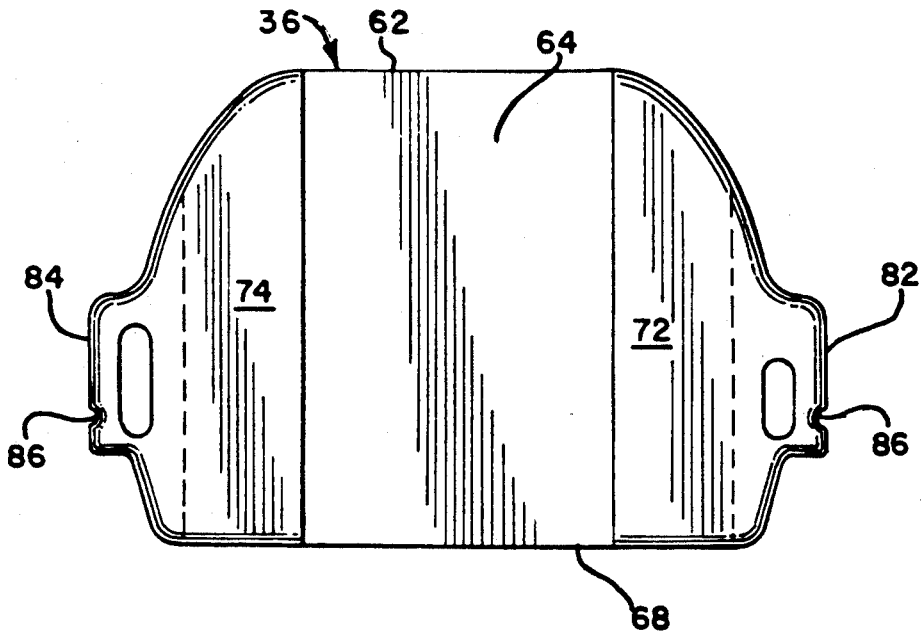
FIG. 3 is a view of the rear face of a wedge shim according to the present invention.
Figure 5:
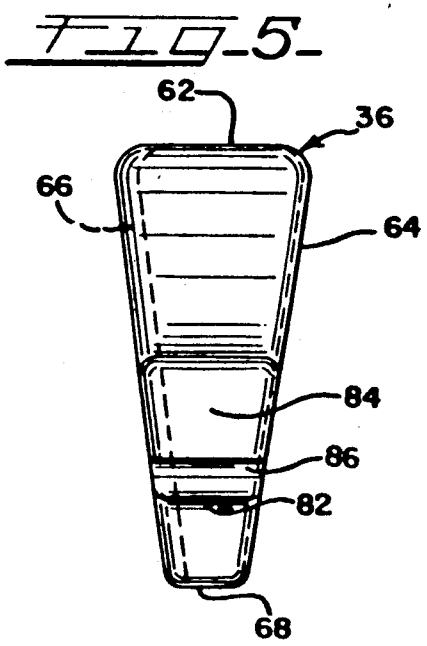
FIG. 5 is a side view of the wedge shim of FIG. 3.
Figure 6:
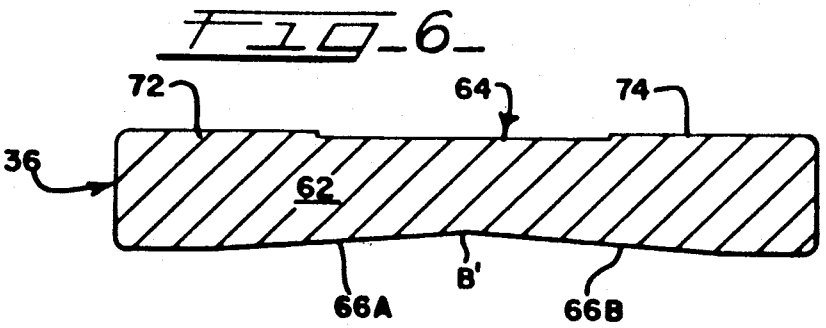
FIG. 6 is a sectional view of the wedge shim taken at line 6—6 of FIG. 4.
Figure 4:
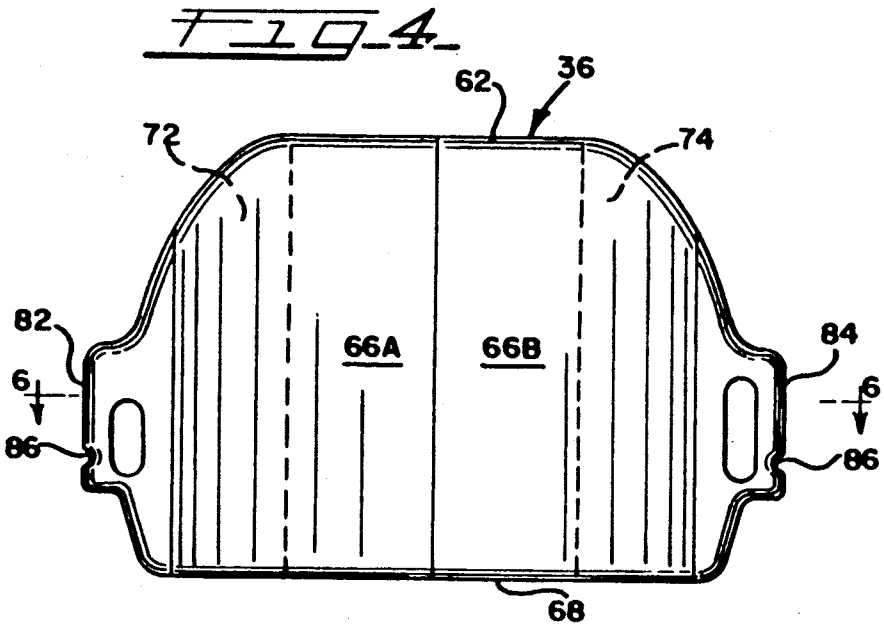
FIG. 4 is a view of the rear face of the wedge shim of FIG. 3.

In FIGS. 3 and 4, it will be seen that the wedge top 62 curves downwardly at each side to tabs 82, 84; and a groove 86 is formed across the lower portion of each tab 82, 84. The purpose of the grooves 86 is to provide an indicator, visible through the inspection portals 52, 54 that signals that the wedge has become or is approaching maximum insertion and that maintenance may be necessary. If maintenance becomes necessary, it is possible to insert tools through the portals 52, 54 directly under the wedge bottom 68 or tabs 82, 84 so as to force the wedge 36 upwardly.

Figure 7:
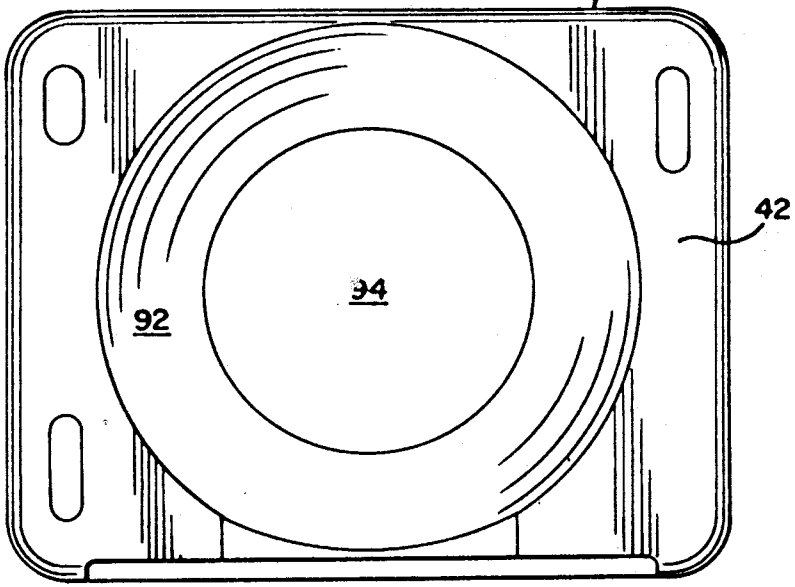
FIG. 7 is a view of the rear face of a follower block according to the present invention.
Figure 8:
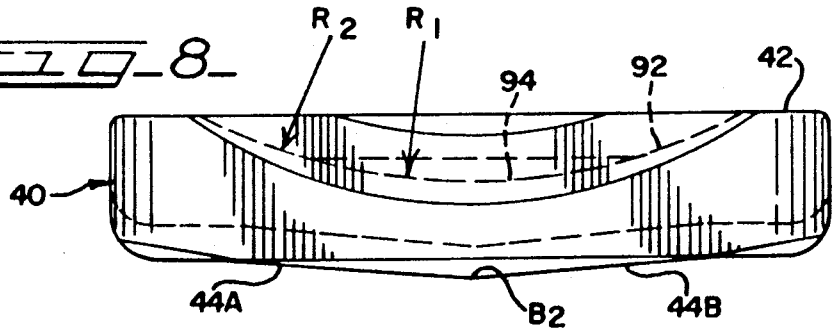
FIG. 8 is a bottom view of the follower block of FIG. 7.
Figure 9:
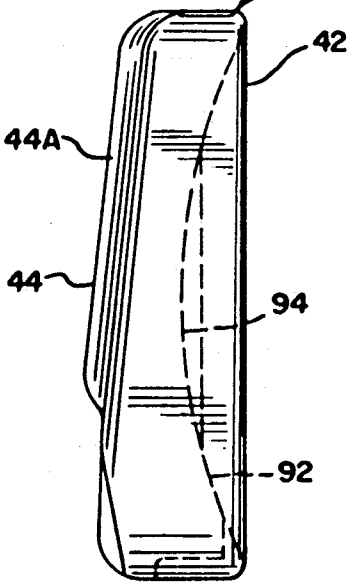
FIG. 9 is a side view of the follower block of FIGS. 7 and 8.

Referring to the preferred follower block 40 shown in detail in FIGS. 7-9, it will be seen that the concave rear bearing surface 42 is formed with a compound curvature to provide a convex annulus 92 that merges smoothly with a relatively shallower inner cavity 94. Preferably, both the annulus 92 and inner cavity 94 are partial spherical surfaces with the inner cavity formed from a radius $R^1$ that is less than the radius $R^2$ of the annulus surface 92. It is to be understood that the annulus 92 is formed to be substantially concentric with the forward end 32 of the male connector member 12, that is the radius $R^2$ of annulus 92 is substantially equal to the radius of the forward end 32 of male connector 12 and both radii $R^1$ and $R^2$ are measured from separate points on an axis normal to the center of the concave surface 42. Thus, the inner cavity 94 having a relatively shallower curvature (smaller radius) will be first contacted by the male connector member 12 upon initial assembly and will hold the arcuate end 32 slightly spaced from the annulus 92. That spacing will disappear during the break-in period of the early service life of the connector assembly as the male connector member 12 hones its forward end 32 and the concave bearing surface, generally 42.

It is also to be noted that the forward face 44 of the preferred follower block 40 comprises two flat surfaces 44A and 44B which join at the vertical center line of the forward face 44 to form an included angle $B^2$. Heretofore, it was intended that the follower block forward face 44 should be congruent with the rear bearing surface 66 of the wedge 36. Thus heretofore, the included angles $B^1$ and $B^2$ were equal. However, it has been found that if the included angle of the convex surfaces (namely angle $B^2$ of the follower block forward surfaces 44A–44B, as illustrated) is greater than the included angle of the concave surfaces (namely angle $B^1$ of the wedge rear surfaces 66A–66B), the first contact upon initial assembly will be at the outer lateral portions of those components. This provides a beneficial result of better resistance to wedge rotation during the break-in period when forces between the components resulting from connector angling are the greatest.

As an example, an articulated connector assembly casting for a 125 ton capacity platform and sixteen inch (16.0 inch) diameter center plate includes a cast steel female member 16 that is approximately two feet four and one half inches (2 ft. 4.5 inches) long with a mounting end (for securement to a platform center sill) that is approximately thirteen and one-half inches (13.5 inches) wide and thirteen inches (13.0 inches) deep and has an internal pocket that is approximately ten inches (10.0 inches) long (measured from the centerline of the vertical pin 18 and center plate). Within the pocket are located a wedge shim 36 of the configuration shown in FIGS. 3–6, that is eight and three quarters inches wide (8.75 inches maximum dimension), five and one-half inches (5.50 inches) deep and has a bottom thickness of ninety-four hundredths inch (0.94 inch). Both of the wedge forward and rear bearing surfaces taper eight degrees (8°) outwardly from vertical lines that are normal to the base. The lands 72, 74 on the forward bearing surface are raised three hundredths inch (0.03 inch) and are separated by a distance of three and sixty-four hundredths inches (3.64 inches); and the included angle $B^1$ on the rear bearing surface is 171.20°. The follower block 40 is of the configuration shown in FIGS. 7–9 and is eight and nine-tenths inches (8.90 inches) wide, seven and thirteen hundredth inches (7.13 inches) deep and has a maximum thickness of two and six hundredths inches (2.06 inches). Centered on the rear bearing surface 42 of the follower block, the inner cavity 94 is four inches (4.0 inches) across (central chord measurement) and is formed from a seven and one-quarter inch (7.25 inch) spherical radius normal to the width and depth centerlines of the follower block. The outer annulus 92 is formed from a seven and one-half inch (7.50 inch) spherical radius. The included angle $B^2$ on the follower block forward bearing face 44 is 172.29° (e.g. $B^2$ exceeds $B^1$ by at least 1°).

The foregoing details have been provided to describe a best mode of the invention and further variations and modifications may be made without departing from the spirit and scope of the invention which is defined in the following claims.

What is claimed is:

1. In a railcar articulated connector wherein an arcuate forward end of a male connector extends into a female member pocket having a top, bottom, and end wall, a wedge shim having front and rear bearing surfaces with lateral edges received in said female member pocket and a follower block with forward and rear bearing surfaces, said follower block spaced from said pocket end wall by said wedge shim, whereby said male connector bears against said rear surface of said follower block, the improvement comprising:

a compound concave curvature to said rear surface of said follower block formed by a central portion and an outer portion, said central portion being formed from a first radius of curvature and said outer portion being formed from a second radius of curvature that is greater than said first radius of curvature.

2. The improved articulated connector of claim 1 including:

raised lands at said lateral edges of said wedge shim, said lands contacting said pocket end wall.

3. The improved articulated connector of claim 1 wherein said central portion of said concave follower block rear surface is a circular cavity and said outer portion is an annulus that surrounds and smoothly merges with said circular cavity.

4. The improved articulated connector of claim 3 wherein said second radius is substantially equal to the radius of said arcuate forward end of said male connector that bears against said follower block.

5. The improved articulated connector of claim 2 wherein said central portion of said concave follower block rear surface is a circular cavity and said outer portion is an annulus that surrounds and smoothly merges with said circular cavity.

6. The improved articulated connector of claim 2 wherein said second radius is substantially equal to the radius of said arcuate forward end of said male connector that bears against said follower block.

7. The improved articulated connector of claim 1 wherein said forward bearing surface of said follower block and said rear bearing surface of said wedge shim comprise chevron-like angled surfaces that form abutting convex and concave bearing surfaces respectively, and the included angle of said concave surface is greater than the included angle of said convex surface.

8. The improved articulated connector of claim 7 wherein the included angle of said concave surface is at least one degree larger than the included angle of said convex surface.

9. The improved articulated connector of claim 2 wherein the forward bearing face of said follower block and rear bearing surface of said wedge comprise chevron-like angled surfaces that form abutting convex and concave bearing surfaces respectively, and the included angle of the concave surface is greater than the included angle of the convex surface.

10. The improved articulated connector of claim 9 wherein the included angle of said concave surface is at least one degree larger than the included angle of said convex surface.

11. The improved articulated connector of claim 9 wherein said central portion of said concave follower block rear surface is a circular cavity and said outer portion is an annulus that surrounds and smoothly merges with said circular cavity.

12. An improved follower block for a railcar connector assembly wherein an arcuate forward end of a male connector member bears against a rear bearing surface of said follower block, the improvement comprising:

a compound concave curvature to said rear bearing surface of said follower block formed by a central portion and an outer portion, said central portion being formed from a first radius of curvature and said outer portion being formed from a second radius of curvature that is greater than said first radius of curvature.

13. The improved follower block of claim 12 wherein said central portion of said concave follower block rear surface is a circular cavity and said outer portion is an annulus that surrounds and smoothly merges with said circular cavity.

14. The improved follower block of claim 13 wherein said second radius is substantially equal to the radius of said arcuate forward end of said male connector that bears against said follower block.

15. An improved wedge shim for a railcar connector assembly to compensate for slack between an end wall of a connector pocket and a follower block in the pocket, said wedge shim defined by top and bottom edges, a pair of side edges connecting said top and bottom edges, a forward bearing surface facing the pocket end wall, and a rear bearing surface facing the follower block, the improvement comprising:

raised flat lands integrally formed with said forward bearing surface of said wedge shim, each of said lands extending horizontally from one of said side edges toward the middle of said forward bearing surface of said wedge shim and along the entire distance from said top edge to said bottom edge of said wedge shim.

* * * * *

UNITED STATES PATENT AND TRADEMARK OFFICE

CERTIFICATE OF CORRECTION

PATENT NO. : 5,133,467

DATED : July 28, 1992

INVENTOR(S) : V. Terrey Hawthorne, Horst T. Kaufhold and John F. Oesch

It is certified that error appears in the above-identified patent and that said Letters Patent is hereby corrected as shown below:

Column 6:

In Claim 7, line 6, delete "concave" and insert --convex--, therefor;

In Claim 7, line 7, delete "convex" and insert --concave--, therefor;

In Claim 8, line 2, delete "concave" and insert --convex--, therefor;

In Claim 8, line 4, delete "convex" and insert --concave--, therefor;

In Claim 9, line 6, delete "concave" and insert --convex--, therefor;

In Claim 9, line 7, delete "convex" and insert --concave--, therefor;

In Claim 10, line 2, delete "concave" and insert --convex--, therefor;

In Claim 10, line 4, delete "convex" and insert --concave--, therefor.

Signed and Sealed this

Sixth Day of June, 1995

*Attest:*

*Attesting Officer*

Bruce Lehman

BRUCE LEHMAN

*Commissioner of Patents and Trademarks*